US010323616B2

(12) United States Patent
Filippi et al.

(10) Patent No.: US 10,323,616 B2
(45) Date of Patent: Jun. 18, 2019

(54) METHOD OF MANUFACTURING AN INJECTOR FOR INJECTING FLUID AND INJECTOR FOR INJECTING FLUID

(71) Applicant: CONTINENTAL AUTOMOTIVE GMBH, Hannover (DE)

(72) Inventors: Stefano Filippi, Castel'Anselmo Collesalvetti (IT); Mauro Grandi, Leghorn (IT); Francesco Lenzi, Leghorn (IT); Valerio Polidori, Leghorn (IT)

(73) Assignee: Continental Automotive GmbH, Hannover (DE)

( * ) Notice: Subject to any disclaimer, the term of this patent is extended or adjusted under 35 U.S.C. 154(b) by 124 days.

(21) Appl. No.: 15/059,346

(22) Filed: Mar. 3, 2016

(65) Prior Publication Data

US 2016/0258407 A1 Sep. 8, 2016

(30) Foreign Application Priority Data

Mar. 5, 2015 (EP) ..... 15157712

(51) Int. Cl.

| | |
|---|---|
| ***F02M 61/16*** | (2006.01) |
| ***F02M 51/06*** | (2006.01) |
| ***F02M 61/18*** | (2006.01) |
| ***F02M 65/00*** | (2006.01) |

(52) U.S. Cl.

CPC ..... *F02M 61/18* (2013.01); *F02M 51/0614* (2013.01); *F02M 51/0671* (2013.01); *F02M 51/0689* (2013.01); *F02M 61/161* (2013.01); *F02M 61/168* (2013.01); *F02M 65/001* (2013.01); *F02M 61/188* (2013.01);
(Continued)

(58) Field of Classification Search

CPC ..... F02M 51/0614; F02M 51/0671–51/0682; F02M 51/0689; F02M 51/0696; F02M 61/001; F02M 61/161; F02M 61/168; F02M 61/18; F02M 61/188; F02M 61/20; F02M 61/205; F02M 65/001; F02M 2200/08; F02M 2200/20; F02M 2200/8061; F02M 2200/8084; F02M 2200/8092

USPC ..... 239/585.1–585.5

See application file for complete search history.

(56) References Cited

U.S. PATENT DOCUMENTS 4,660,011 A * 4/1987 Reiter ..... F02M 51/0632 251/129.01

5,104,046 A 4/1992 Sakagami (Continued)

FOREIGN PATENT DOCUMENTS

JP 2757220 B2 5/1998

JP 3267623 B2 3/2002

(Continued)

*Primary Examiner* — Viet Le

*Assistant Examiner* — Cody J Lieuwen

(74) *Attorney, Agent, or Firm* — Laurence A. Greenberg; Werner H. Stemer; Ralph E. Locher

(57) ABSTRACT

A valve assembly is provided with a valve body, a valve needle and an armature. An actuator assembly surrounds the valve assembly. The actuator assembly includes a housing and a coil. The coil can be energized so as to induce a force for axially displacing the armature. A flow characteristic of fluid to be injected by the injector is adjusted by axially shifting the valve assembly and the actuator assembly relative to one another.

18 Claims, 5 Drawing Sheets

(52) U.S. Cl.
CPC ..... *F02M 2200/8061* (2013.01); *F02M 2200/8084* (2013.01); *F02M 2200/8092* (2013.01)

(56) References Cited

U.S. PATENT DOCUMENTS

| | | | | | |
|---|---|---|---|---|---|
| 5,157,967 | A | * | 10/1992 | Wieczorek | F02M 51/0685 73/114.48 |
| 5,494,223 | A | | 2/1996 | Hall et al. | |
| 5,560,386 | A | * | 10/1996 | Reiter | F02M 51/0667 137/1 |
| 6,142,395 | A | * | 11/2000 | Reiter | F02M 51/0671 239/585.1 |
| 6,264,112 | B1 | | 7/2001 | Landschoot et al. | |
| 6,405,427 | B2 | | 6/2002 | Kummer | |
| 7,389,952 | B2 | | 6/2008 | Dallmeyer | |
| 2003/0116655 | A1 | * | 6/2003 | Reiter | F02M 51/0614 239/585.1 |
| 2008/0105770 | A1 | * | 5/2008 | Biasci | F02M 61/168 239/584 |
| 2015/0260135 | A1 | * | 9/2015 | Izzo | F02M 51/061 123/482 |
| 2015/0260138 | A1 | * | 9/2015 | Filippi | F02M 51/0671 239/585.5 |

FOREIGN PATENT DOCUMENTS

| | | | |
|---|---|---|---|
| WO | 9423195 | A1 | 10/1994 |
| WO | 9606281 | A1 | 2/1996 |
| WO | 0043666 | A1 | 7/2000 |
| WO | 0200713 | A1 | 1/2002 |
| WO | 2006017536 | A1 | 2/2006 |
| WO | 2011121839 | A1 | 10/2011 |

* cited by examiner

METHOD OF MANUFACTURING AN INJECTOR FOR INJECTING FLUID AND INJECTOR FOR INJECTING FLUID

CROSS-REFERENCE TO RELATED APPLICATION

This application claims the priority, under 35 U.S.C. § 119, of European patent application EP15157712, filed Mar. 5, 2015; the prior application is herewith incorporated by reference in its entirety.

BACKGROUND OF THE INVENTION

Field of the Invention

The invention relates to a method of manufacturing an injector for injecting fluid and to an injector for injecting fluid, particularly an injector for injecting fuel into an internal combustion engine.

Injection valves are in widespread use, in particular for internal combustion engines where they may be arranged in order to dose the fluid into an intake manifold of the internal combustion engine or directly into the combustion chamber of a cylinder of the internal combustion engine.

Injection valves are manufactured in various forms in order to satisfy the various needs for the various combustion engines. Therefore, for example, their length, diameter as well as various elements of the injection valve which are responsible for the way the fluid is dosed, may vary within a wide range. In addition to that, injection valves may accommodate an actuator for actuating a valve needle of an injection valve which may, for example be an electromagnetic actuator.

In order to enhance the combustion process with regard to the reduction of unwanted emissions, the respective injection valve may be suited to dose fluids under very high pressure. The pressure may, for example in the case of a gasoline engine, be in the range of up to 400 bar, and in the case of diesel engines in the range of up to 3,500 bar.

SUMMARY OF THE INVENTION

It is accordingly an object of the invention to provide a method for manufacturing an injector which overcomes the above-mentioned and other disadvantages of the heretofore-known devices and methods of this general type and which provides for a manufacturing method that contributes to a cost-efficient production as well as preciseness and reliability of the injector.

With the foregoing and other objects in view there is provided, in accordance with the invention, a method of manufacturing an injector for injecting fluid, the method comprising:

providing a valve assembly having a valve body, a valve needle and an armature, the valve body defining a longitudinal axis and being formed with a cavity configured to receive therein the valve needle and the armature, the valve needle and the armature being mounted for axial movement relative to the valve body and being operable to control an injection of fluid from the cavity to an exterior of the injector;

providing an actuator assembly surrounding the valve assembly, the actuator assembly including a housing and a coil, the coil being energizeable to induce a force for axially displacing the armature; and adjusting a flow characteristic of the fluid to be injected by the injector by axially shifting the valve assembly and the actuator assembly relative to one another.

In accordance with one step of the method, a valve assembly is provided, comprising a valve body, a valve needle and an armature. The valve body has a longitudinal axis and is formed with a cavity. The cavity is operable to take in the valve needle and the armature, i.e. the valve needle and the armature are in particular arranged in the cavity. The valve needle and the armature are axially movable relative to the valve body and operable to control an injection of fluid from the cavity to external to the injector. Preferably, the valve assembly comprises a valve spring which is preloaded to bias the valve needle towards a closing position in which the valve needle is in sealing contact with the valve body for preventing fluid flow from the cavity.

Moreover, according to a further step of the method, an actuator assembly is provided, surrounding the valve assembly. In particular, the actuator assembly is provided and the actuator assembly and the valve assembly are positioned relative to one another in such fashion that the actuator assembly surrounds the valve assembly. The actuator assembly comprises a housing and a coil. When the coil is energized, it induces a force for axially displacing the armature. In an expedient development, the housing is a metal housing and represents a magnetic yoke.

A flow characteristic of fluid to be injected by the injector is adjusted by axially shifting the valve assembly and the actuator assembly relative to each other according to one step of the method.

Advantageously, adjusting the flow characteristic of fluid by axial shifting of the actuator assembly which is located outside of the valve assembly contributes to a cost-efficient manufacturing of the injector as well as its precise operation. In particular, it can be avoidable that a calibration element inside the cavity has to be accessed and moved—e.g. for changing the bias of the valve spring located inside the cavity—while the injector is operated for calibration purposes.

Particularly, the flow characteristic of fluid may be representative of an amount of injected fluid under a predetermined condition. In particular, the predetermined condition may comprise a temperature and/or a pressure of fluid to be injected. Additionally or alternatively, the flow characteristic of fluid may be representative of the amount of injected fluid per time, i.e. a flow rate of injected fluid.

The flow characteristic of fluid is particularly dependent on a magnitude of the force on the armature, induced by a magnetic field of the coil. Moreover, the magnitude of the force on the armature is dependent on an axial displacement of the valve assembly and the actuator assembly relative to each other. Thus, axially shifting the valve assembly and the actuator assembly relative to each other dependent on the flow characteristic of fluid enables a precise adjustment of the injector.

Advantageously, a variability of the flow characteristic of fluid is thus kept low. Adjusting the flow characteristic of fluid by axially shifting the valve assembly and the actuator assembly relative to each other may be easily applied without complex equipment in mass production.

In one embodiment of the method, the actuator assembly comprises a further magnetic element in addition to the coil. The magnetic element is operable to induce a force for axially displacing the armature.

Advantageously, the magnetic element contributes to the dependency of the flow characteristic of fluid on the axial displacement of the valve assembly and the actuator assembly relative to each other, for example by increasing the magnitude of the force applied on the armature. That is, the magnetic element enhances a sensitivity of the flow characteristic of fluid to the axial displacement of the valve assembly and the actuator assembly relative to each other, particularly when adjusting the flow characteristic of fluid of the injector, hence contributing to a reliable adjustment of the injector.

In a further embodiment of the method, a physical model is provided according to one method step, the physical model having an input parameter. Preferably, the injector is operated for determining a value of the input parameter. Depending on the input parameter, a shifting value is determined. In particular, the shifting value is determined by using the physical model with the determined value of the input parameter. Depending on the shifting value, the valve assembly and the actuator assembly are axially shifted relative to each other. The shifting value is in particular a distance by which the valve assembly and the actuator assembly are axially displaced relative to each other for adjusting the flow characteristic.

In one development, the method further comprises operating the injector for determining a further value of the input parameter after axially shifting the valve assembly and the actuator assembly relative to each other. The determined further value of the input parameter—or of another value derived therefrom—is subsequently compared with a target value. If the deviation of the further value from the target value exceeds a predetermined error value, determination of the shifting value and axial shifting of the valve assembly and the actuator assembly relative to each other in dependence on the shifting value is repeated.

Advantageously, axially shifting the valve assembly and the actuator assembly relative to each other dependent on the input parameter contributes to a time-efficient adjustment. Particularly in the case of iterative shifting, this enables few iteration steps.

Particularly, the input parameter may be representative of the flow characteristic of fluid to be injected. In particular, the input parameter may be representative of the force on the armature.

Particularly, the shifting value may be representative of the axial displacement of the valve assembly and the actuator assembly relative to each other with respect to predetermined positions. The valve assembly and the actuator assembly are particularly shifted relative to each other by a distance corresponding to the shifting value such that the flow characteristic of fluid corresponds to a predetermined value under the predetermined condition.

In a further embodiment, the method comprises a step of fixedly coupling the valve assembly and the actuator assembly to each other after adjusting the flow characteristic of fluid to be injected by the injector. Advantageously, fixedly coupling the valve assembly and the actuator assembly contributes to a precise operation of the injector over its life time cycle.

In accordance with a preferred feature of the invention, the method comprises a step of welding the valve assembly and the actuator assembly to each other. Advantageously, fixedly coupling the valve assembly and the actuator assembly by welding efficiently contributes to the precise operation of the injector over its life time cycle.

In a further embodiment, the fluid is a gas, particularly air or nitrogen. Advantageously, using gas when adjusting the injector contributes to cheap and environmentally friendly manufacturing of the injector. Moreover, a fluid filter for filtering the fluid is merely optional in this case.

In a further embodiment, the fluid is a liquid, particularly N-heptane.

With the above and other objects in view there is also provided, in accordance with the invention, an injector for injecting fluid, the injector comprising:

a valve assembly having a valve body, a valve needle and an armature, said valve body defining a longitudinal axis and being formed with a cavity configured to receive therein said valve needle and said armature, said valve needle and said armature being mounted for axial movement relative to said valve body and being operable to control a flow rate of injected fluid from the cavity to an exterior of said injector;

an actuator assembly surrounding said valve assembly, said actuator assembly having a housing and a coil, said coil being energizeable to induce a force for axially displacing the armature; and wherein said valve assembly and said actuator assembly are shaped and disposed to enable an adjustment of a flow characteristic of fluid to be injected by the injector by axially shifting said valve assembly and said actuator assembly relative to one another during an assembly of the injector.

The novel injector is particularly shaped and configured for being manufactured with the method as described above.

More specifically, the injector has a valve assembly, comprising a valve body, a valve needle and an armature. The valve body has a longitudinal axis and comprises a cavity. The cavity is operable to take in the valve needle and the armature. The valve needle and the armature are axially movable relative to the valve body and operable to control a flow rate of injected fluid from the cavity to external to the injector.

The injector further comprises an actuator assembly, surrounding the valve assembly. The actuator assembly comprises a housing, a coil. Preferably, it also comprises a further magnetic element. The coil is energizeable to induce, in particular together with the magnetic element, a force for axially displacing the armature.

The valve assembly and the actuator assembly may expediently be shaped and arranged in such fashion that a flow characteristic of fluid to be injected by the injector is adjustable by axially shifting the valve assembly and the actuator assembly relative to each other during assembling of the injector. In this way, particularly easy and cost efficient manufacturing of the injector is achievable.

In one embodiment, the valve assembly and the actuator assembly are friction-locked. Preferably, the valve assembly and the actuator assembly are not in form-fit engagement which blocks relative axial movement of the valve assembly and the actuator assembly. In particular, the actuator assembly does not laterally overlap and portion of the valve assembly which is overlaps axially. In other words, absent the friction-lock and other connections—such as welded, adhesive or screwed connections—which are formed after adjusting the flow characteristic as the case may be, the actuator assembly has an axial play with respect to the valve assembly in both axial directions.

Advantageously, this contributes to cost- and time-efficient manufacturing of the injector. Moreover, it is contributed to a precise operation of the injector over its life time cycle.

In accordance with an added feature of the invention, the magnetic element is a permanent magnet. The permanent magnet contributes to cost-efficient manufacturing of the injector as well as its reliable operation.

In accordance with an additional feature of the invention, the magnetic element is arranged such that its poles are radially oriented with respect to the longitudinal axis.

Advantageously, a radial orientation of the poles of the magnetic element contributes to the dependency of the flow characteristic of fluid on the axial displacement of the valve assembly and the actuator assembly relative to each other, for example by increasing the magnitude of force applied on the armature. That is, a sensitivity of the flow characteristic of fluid to the axial displacement of the valve assembly and the actuator assembly relative to each other is enhanced, particularly when adjusting the flow characteristic of fluid of the injector.

In accordance with a further feature of the invention, the valve assembly includes a valve spring for axially biasing the valve needle, received in the cavity.

In accordance with again a further feature of the invention, a stiffness of the valve spring is equal to 25 N/mm or higher. Advantageously, the stiffness of the valve spring, particularly 25 N/mm or higher, contributes to a prevention of bouncing of valve needle during operation of the injector. Particularly, this contributes to controlling the flow characteristic of fluid.

In accordance with yet another feature of the invention, the valve assembly and the actuator assembly are fixedly coupled to each other. In a further embodiment according to the second aspect, the valve assembly and the actuator assembly are welded to each other. In other words, a rigid connection is established between the valve assembly and the actuator assembly, the rigid connection preferably being a welded connection. The injector is in particular shaped and configured such that the rigid connection can be established subsequent to axially displacing the valve assembly and the actuator assembly for calibrating the flow characteristic. Expediently, the valve assembly and the actuator assembly may be axially displaceable relative to one another in both axial directions absent the rigid connection.

Other features which are considered as characteristic for the invention are set forth in the appended claims.

Although the invention is illustrated and described herein as embodied in method for manufacturing an injector for injecting fluid and injector for injecting fluid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
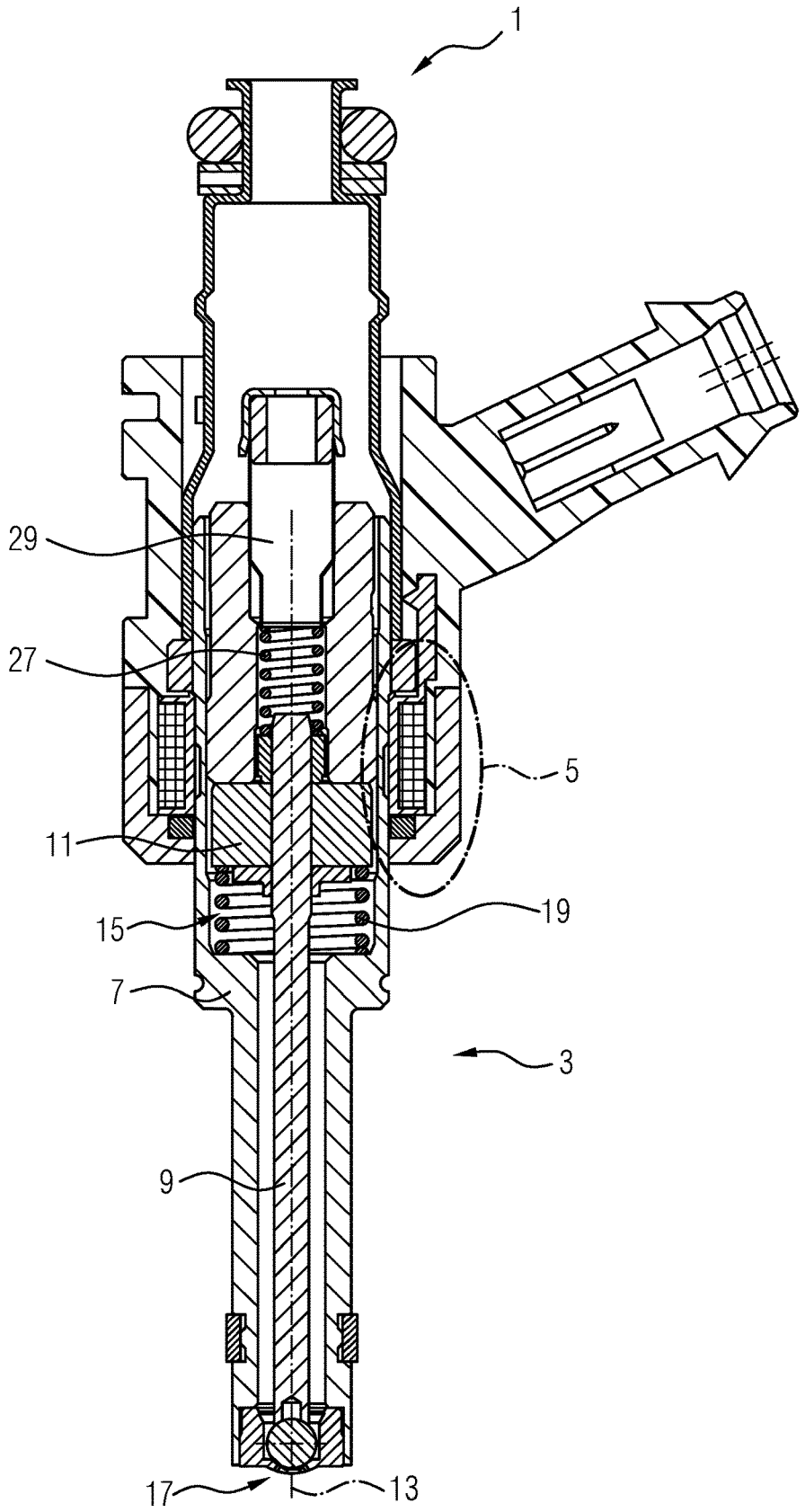
FIG. 1 is a longitudinal section through an embodiment of an injector according to the invention.
Figure 2:
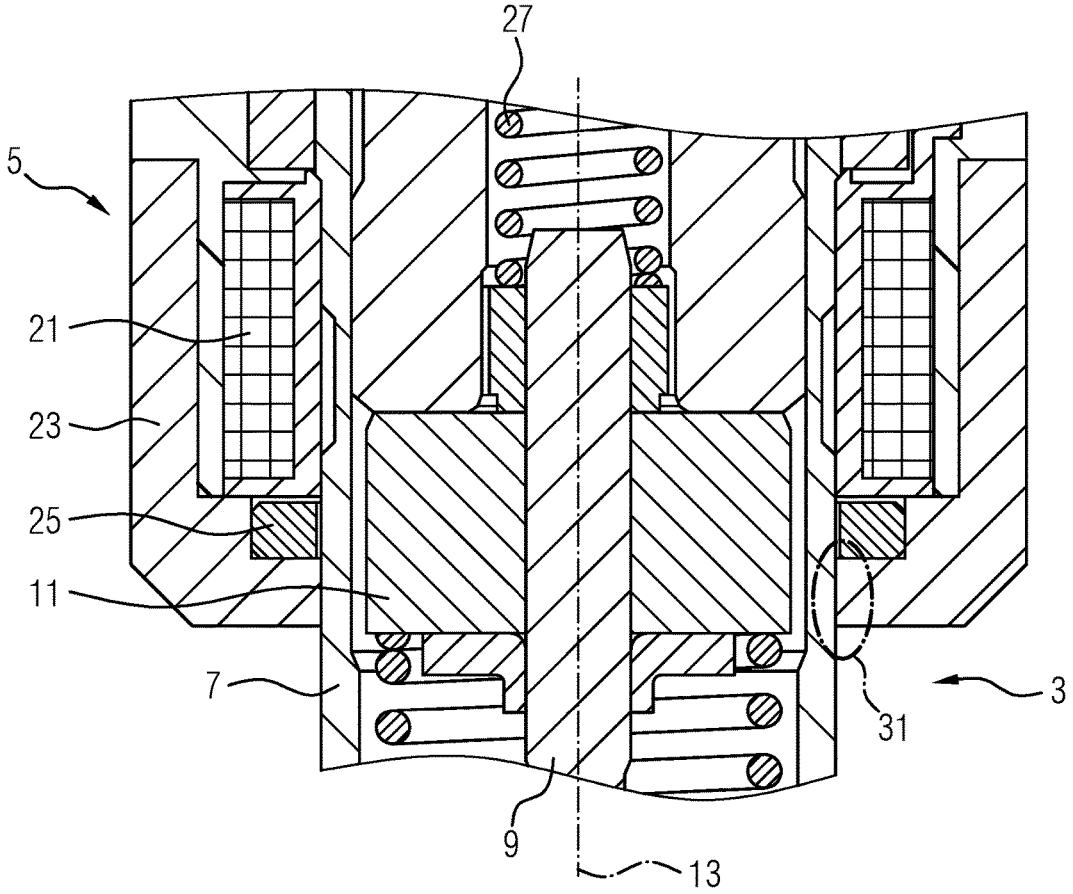
FIG. 2 shows an enlarged longitudinal section view of the injector according to FIG. 1.

Referring now to the figures of the drawing in detail and first, particularly, to FIGS. 1 and 2 thereof, there is shown an exemplary embodiment of an injector 1 with a valve assembly 3 and an electromagnetic actuator assembly 5. The injector of the present embodiment is a fuel injector which is configured for injecting fuel, such as gasoline, directly into a combustion chamber of an internal combustion engine.

The valve assembly 3 comprises a valve body 7, a valve needle 9 and an armature 11. The valve body 7 has a longitudinal axis 13 and has a cavity 15 formed therein with a valve seat 17.

The valve needle 9 is received in the cavity 15 and is axially movable relative to the valve body 7. In a closing position, in which the valve needle 9 is seated on the valve seat 17, the valve needle 9 is operable to prevent an injection of fluid from the cavity 15 outwardly out of the injector 1. In the present embodiment, the fluid is injected into the combustion chamber. The valve needle 9 is further operable to enable the injection of fluid when it is axially displaced away from the closing position.

The armature 11 is mechanically coupled to the valve needle 9—in particular the armature 11 is operable to establish a form-fit connection with the valve needle 9—for axially displacing the valve needle 9 away from the closing position. It has an axial play relative to the valve needle 9. The injector 1 may comprise a first spring 19 for biasing the armature 11 in mechanical contact with the valve needle 9.

The electromagnetic actuator assembly 5 comprises a magnetic coil 21, in particular solenoid, positioned in a metallic housing 23. The housing 23 circumferentially surrounds a portion of the valve body 7. The magnetic coil 21, the housing 23, the valve body 7, a pole piece which is fixed inside the valve body 7, and the armature 11 form a magnetic circuit. When the magnetic coil 21 is energized, it generates a magnetic field which attracts the armature 11 towards the pole piece.

Due to the mechanic coupling of the armature 11 with the valve needle 9, the electromagnetic actuator assembly 5 is thus operable to exert a force for influencing a position of the valve needle 9. Particularly, the valve needle 9 may be axially displaced by the electromagnetic actuator assembly 5 relative to the valve body 7 away from the closing position against the spring force of a valve spring 27.

The valve spring 27 is arranged and preloaded for biasing the valve needle 9 towards the closing position, in particular in order to contribute to a leak-tightness of the injector 1. A calibration element 29, in particular a calibration tube, may be received in the cavity 15 and press-fitted into the valve body 7 or into another part of the injector 1 which is positionally fixed relative to the valve body 7. The calibration element 29 axially abuts the valve spring 27. In particular, the valve spring 27 is seated on the calibration element 29 at one axial end and on the valve needle 9 at its opposite axial end.

The actuator assembly 5 may further comprise a magnetic element 25 (cf. e.g. FIG. 2). In this embodiment, the magnetic element 25 is a permanent magnet. In other embodiments, the magnetic element 25 may be an electromagnet.

Particularly, the magnetic element 25 is received in a recess of the housing 23. The magnetic element 25 exerts a force for influencing the position of the valve needle 9. In particular, the valve needle 9 may be subjected to a force of the magnetic element 25 and the coil 21, when the coil 21 is energized.

Figure 3:
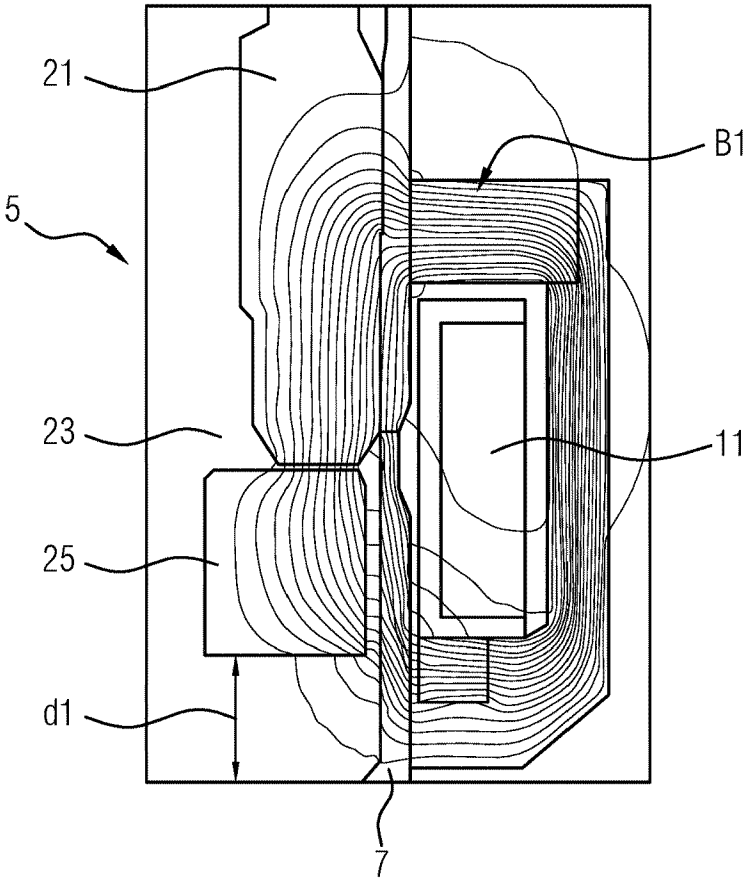
FIG. 3 shows a first enlarged longitudinal section view of a valve assembly and an actuator assembly of the injector according to FIG. 1.

Referring now to FIG. 3, there is shown a first enlarged longitudinal section view of the injector 1, wherein the valve assembly 3 and the actuator assembly 5 are assembled together, comprising a first axial displacement d1 relative to each other with respect to predetermined reference positions.

A magnetic field of the coil 21 and the magnetic element 25, when the coil 21 is energized, is visualized by first field lines B1.

Figure 4:
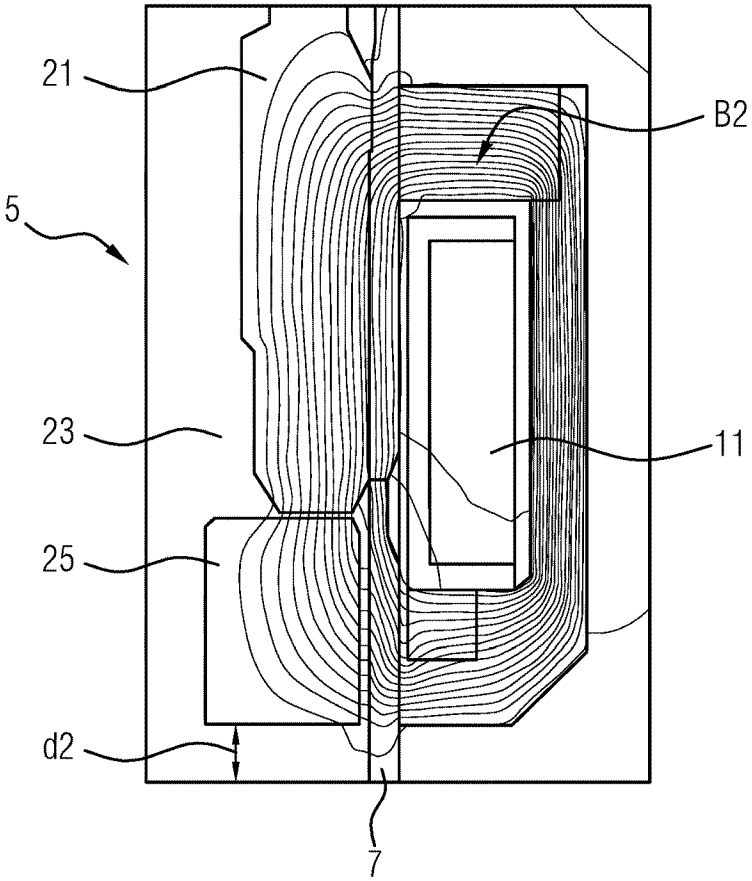
FIG. 4 shows a second enlarged longitudinal section view a valve assembly and an actuator assembly of the injector according to FIG. 1.

FIG. 4 shows a second enlarged longitudinal section view of the injector 1, wherein the valve assembly 3 and the actuator assembly 5 are assembled together, comprising a second axial displacement d2 relative to each other with respect to the predetermined reference positions.

The magnetic field of the coil 21 and the magnetic element 25, when the coil 21 is energized, is visualized by second field lines B2.

Figure 5:
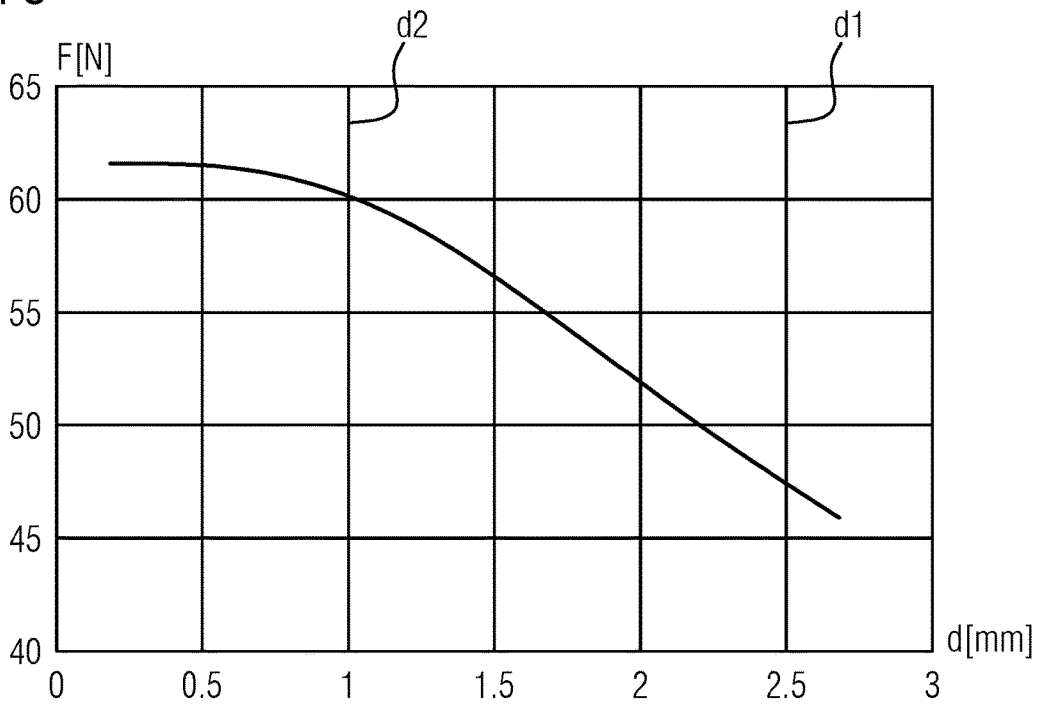
FIG. 5 shows a graph of a force applied on an armature of the injector according to FIG. 1 over an axial displacement of its valve assembly and its actuator assembly relative to each other.

A force F induced by the magnetic field of the coil 21 and the magnetic element 25, when the coil 21 is energized, is dependent on an axial displacement d of the valve assembly 3 and the actuator assembly 5 relative to each other with respect to the predetermined reference positions (FIG. 5). The force F substantially increases with decreasing axial displacement d. The magnetic element 25 may enhance this dependency of the force F on the axial displacement d, as well as a magnitude of the force F. In particular by means of the magnetic element 25, a gradient of the force F is achieved which has, for example, a value between 10 N/mm inclusive and 14 N/mm inclusive, allowing for precise adjustment of the flow characteristic of fluid.

In this context, the magnetic element 25 is, in particular, radially oriented with respect to the longitudinal axis 13, that is, a plane in which both magnetic poles of the magnetic element 25 are located is arranged perpendicular to the longitudinal axis 13. In other words, the magnetic poles of the magnetic element 25 are arranged in radially subsequent fashion.

The valve spring 27 may have a stiffness of 18 N/mm or higher. Particularly, the valve spring 27 has a predetermined stiffness, in particular 25 N/mm or higher. This contributes to a prevention of bouncing of the valve needle during the operation of the injector.

In one embodiment, the calibration element 29 may be operable to adjust a bias of the valve spring 27 in order to adjust a flow characteristic of fluid to be injected by the injector 1. In this embodiment however, the valve spring 27 is solely seated on the calibration element 29, the bias of the valve spring 27 being substantially constant.

Figure 6:
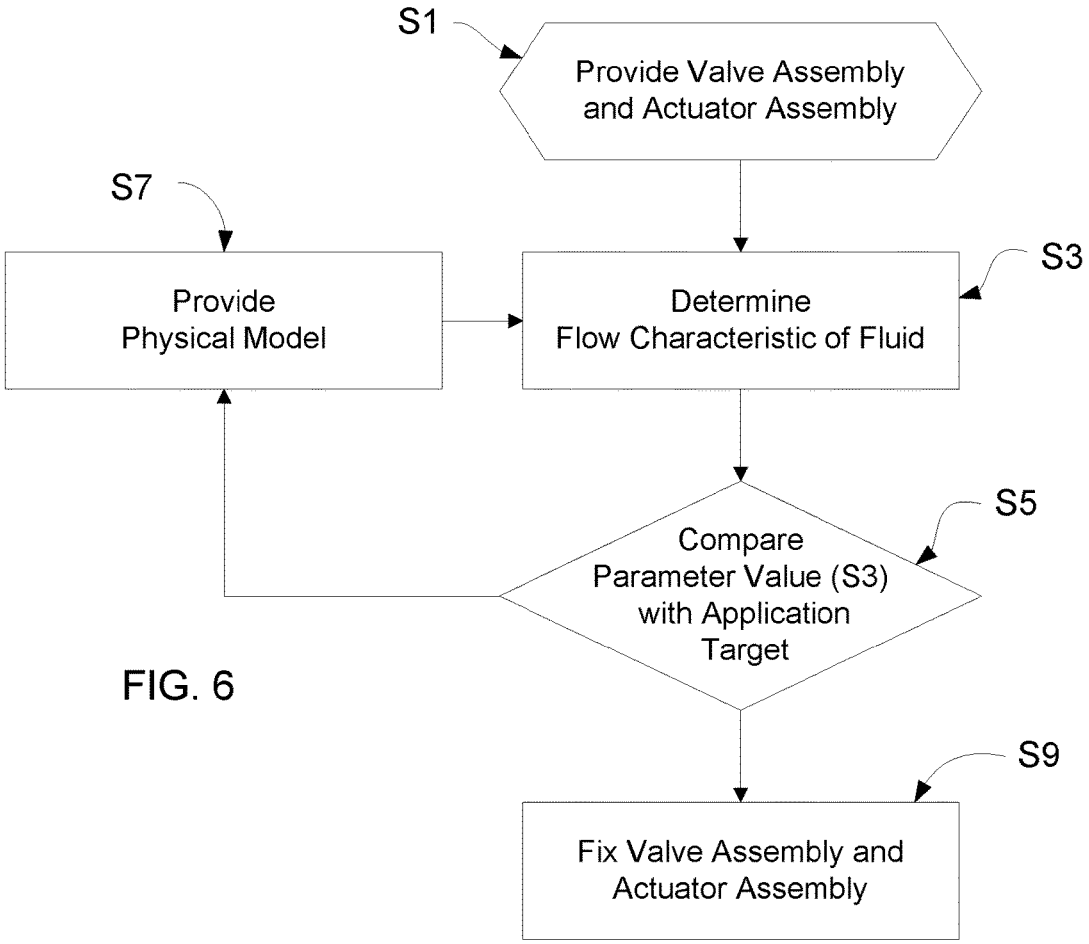
FIG. 6 shows a flow chart of a method for manufacturing the injector according to FIG. 1.

In the following, one embodiment of a method for manufacturing the injector 1 is described with the aid of the flow chart of FIG. 6.

In step S1, the valve assembly 3 and the actuator assembly 5 are provided. Particularly, the valve assembly 3 and the actuator assembly 5 are provided in a way that the actuator assembly 5 surrounds the valve assembly 3 such that the actuator assembly 5 is operable to influence an axial displacement of the valve needle 9. For example, the actuator assembly 5 and the valve assembly 3 are axially shifted relative to one another until they are in the predetermined reference positions.

The valve spring 27 may be pre-loaded to a predetermined preload, in particular before shifting the actuator assembly 5 over the valve assembly 3.

The valve assembly 3 and the actuator assembly 5 may be releasably coupled together in order to allow for operation of the injector 1 as well as its adjustment. In this context, the valve assembly 3 and the actuator assembly 5 are particularly friction-locked. The valve assembly 3 and the actuator assembly 5 may particularly be preassembled, for example by coupling the valve assembly 3 and the actuator assembly 5 within an engagement area 31 (see FIG. 2).

Only in order to make the friction lock visible, the housing 23 is depicted to overlap the valve body 7 in radial inward direction in the engagement area 31 in FIG. 2. However, the valve assembly 3 and the actuator assembly 5 are in fact not in a form-fit engagement. Rather, the actuator assembly 5 is displaceable in both axial directions along the valve body 7. For example, the actuator assembly 5 has a central axial opening which is delimited by a cylindrical inner surface and the valve assembly 3 has a cylindrical outer surface which extends over complete axial length of the cylindrical inner surface of the actuator assembly 5, axially projects beyond the cylindrical inner surface on both sides. The cylindrical outer surface of the valve assembly 3 in particular contacts the cylindrical inner surface of the actuator assembly 5 at least in places for establishing the friction lock.

In step S3, a value of a parameter which is representative for the flow characteristic of fluid to be injected by the injector 1 is determined under predetermined conditions. In this embodiment, the injector 1 is operated and an amount of injected fluid from the cavity 15 to outside the injector 1 is measured. Additionally or alternatively, the amount of injected fluid within a given time window is measured, that is, a flow rate of injected fluid is determined. Particularly in case of the fluid being nitrogen, an instantaneous flow rate may be determined.

In other embodiments, values of an additional and/or alternative parameter may be determined, representing the flow characteristic of fluid to be injected, for example the force F exerted on the valve needle 9, the axial displacement d of the valve assembly 3 and the actuator assembly 5 relative to each other and in particular with respect to the predetermined positions, a magnetic field, or a so called feedback closing signal. The feedback closing signal is in particular a voltage change due to a velocity change of the valve needle 9 during the axial movement of the valve needle 9 for closing the valve, in particular when the valve needle 9 hits the valve seat 17.

The fluid to be injected during operation of the injector 1 for calibrating the flow characteristic when manufacturing the injector 1 may be a gas such as nitrogen or air. Alternatively, the fluid may be a liquid such as N-Heptane, particularly corresponding with its injection related properties to those of fuel.

When determining the flow characteristic of fluid to be injected, the injector 1 may be arranged in an environment with known border conditions such as temperature and/or fluid pressure of fluid to be injected, particularly in order to ensure reproducibility.

Additionally and/or alternatively, the injector 1 may be supplied with fluid under predetermined border conditions, that is, for example, the injector is supplied with fluid at a predetermined fluid pressure and/or a predetermined temperature.

In step S5, the parameter value determined in step S3 is compared to a predetermined value, a so-called 'application target' of the flow characteristic of fluid. If a deviation of the determined parameter value from the predetermined value exceeds a predetermined error value, the method is continued in step S7. Otherwise, the method is continued in step 9.

In step S7, a physical model is provided, the physical model having at least one input parameter. The input parameter may, for example, be the parameter determined in step S3. Moreover, border conditions may be provided as respective and in particular additional input parameters to the physical model.

The physical model particularly relates the flow characteristic of fluid to the axial displacement d of the valve assembly 3 and the actuator assembly 5 relative to each other with respect to the predetermined positions.

In one embodiment, a first data set corresponding to the graph of FIG. 5 may be provided, mapping the force F exerted on the armature 11 to the axial displacement d. In this case, for example, a further data set is provided, mapping the measured parameter which is representative for the flow characteristic of fluid to the force F of the first data set. Hence, depending on the flow characteristic of fluid, the axial displacement d of the valve assembly 3 and the actuator assembly 5 relative to each other with respect to the predetermined positions can be determined.

Dependent on the determined value of the input parameter, a shifting value is determined using the physical model. The valve assembly 3 and the actuator assembly 5 are subsequently axially shifted relative to each other by the shifting value. In this embodiment, particularly in case of iterative adjustment of the flow characteristic of fluid, the method is continued in step 3. In other embodiments, the method may be continued in step S9.

In step S9, the valve assembly 3 and the actuator assembly 5 are fixedly coupled together, particularly long-lasting. In this embodiment, the valve assembly 3 and the actuator assembly 5 are welded together at the engagement area 31 (see FIG. 2). Particularly in case that the valve assembly 3 and the actuator assembly 5 are friction-locked, step S9 is optional but may improve long-term stability of the flow characteristic and reduce the risk that the flow characteristic is changed, for instance due to mechanical vibrations and/or shocks.

The invention claimed is:

1. A method of manufacturing an injector for injecting fluid, the method comprising:

providing a valve assembly having a valve body, a valve needle and an armature, the valve body defining a longitudinal axis and being formed with a cavity configured to receive therein the valve needle and the armature, the valve needle and the armature being mounted for axial movement relative to the valve body and being operable to control a flow rate of injected fluid from the cavity to an exterior of the injector;

providing an actuator assembly surrounding the valve assembly, the actuator assembly including a housing and a magnetic coil, the coil being energizeable to induce a force for axially displacing the armature;

providing a further magnetic element disposed axially next to the magnetic coil along the longitudinal axis and radially surrounding the valve assembly in a position between the housing and the magnetic coil, the further magnetic element being a permanent magnet or an electromagnet; and adjusting a flow characteristic of the fluid to be injected by the injector by axially shifting the valve body and the actuator assembly relative to one another.

2. The method according to claim 1, wherein the further magnetic element is operable to induce a force for axially displacing the armature.

3. The method according to claim 1, which further comprises:

providing a physical model having an input parameter;

operating the injector for determining a value of the input parameter;

determining a shifting value by using the physical model with the determined value of the input parameter; and axially shifting the valve assembly and the actuator assembly relative to one another depending on the shifting value thus determined.

4. The method according to claim 1, which further comprises a step of fixedly coupling the valve assembly and the actuator assembly to one another after the adjusting step.

5. The method according to claim 4, which comprises welding the valve assembly and the actuator assembly to one another.

6. The method according to claim 1, wherein the fluid is a gas.

7. The method according to claim 6, wherein the fluid is air or nitrogen.

8. The method according to claim 1, wherein the fluid is a liquid.

9. The method according to claim 8, wherein the fluid is N-heptane.

10. An injector for injecting fluid, the injector comprising:

a valve assembly having a valve body, a valve needle and an armature, said valve body defining a longitudinal axis and being formed with a cavity configured to receive therein said valve needle and said armature, said valve needle and said armature being mounted for axial movement relative to said valve body and being operable to control a flow rate of injected fluid from the cavity to an exterior of said injector;

an actuator assembly surrounding said valve assembly, said actuator assembly having a housing and a magnetic coil, said magnetic coil being energizeable to induce a force for axially displacing the armature;

a further magnetic element disposed axially next to said magnetic coil along the longitudinal axis and radially surrounding said valve assembly in a position between said housing and said magnetic coil, said further magnetic element being a permanent magnet or an electromagnet; and wherein said valve assembly and said actuator assembly are shaped and disposed to enable an adjustment of a flow characteristic of fluid to be injected by the injector by axially shifting said valve body and said actuator assembly relative to one another during an assembly of the injector.

11. The injector according to the claim 10, wherein said valve assembly and said actuator assembly are friction-locked to one another, but said valve assembly and said actuator assembly are not positively engaged so as to block a relative axial movement of said valve assembly and said actuator assembly.

12. The injector according to the claim 10, wherein said valve assembly comprises a valve spring disposed to axially bias said valve needle, said valve spring being received in said cavity and having a stiffness equal to 25 N/mm or higher.

13. The injector according to the claim 10, wherein a rigid connection is established between said valve assembly and said actuator assembly.

14. The injector according to the claim 13, wherein said rigid connection is a welded connection.

15. The injector according to the claim 10, wherein said further magnetic element is arranged with poles thereof oriented radially with respect to the longitudinal axis.

16. The injector according to the claim 10, wherein said magnetic coil and said further magnetic element are disposed in said housing.

17. The injector according to the claim 10, wherein said further magnetic element is oriented radially with respect to the longitudinal axis with both magnetic poles thereof in a plane that is orthogonal to the longitudinal axis.

18. An injector for injecting fluid, the injector comprising:

a valve assembly having a valve body, a valve needle and an armature, said valve body defining a longitudinal axis and being formed with a cavity configured to receive therein said valve needle and said armature, said valve needle and said armature being mounted for axial movement relative to said valve body and being operable to control a flow rate of injected fluid from the cavity to an exterior of said injector;

an actuator assembly surrounding said valve assembly, said actuator assembly having a housing and a magnetic coil, said magnetic coil being energizeable to induce a force for axially displacing the armature, said actuator assembly does not laterally overlap any portion of said valve assembly which said actuator assembly overlaps axially;

a further magnetic element disposed axially next to said magnetic coil along the longitudinal axis and radially surrounding said valve assembly, said further magnetic element being a permanent magnet or an electromagnet; and wherein said valve assembly and said actuator assembly are shaped and disposed to enable an adjustment of a flow characteristic of fluid to be injected by the injector by axially shifting said valve assembly and said actuator assembly relative to one another during an assembly of the injector.

* * * * *